United States Patent [19]

Schmidt

[11] 4,271,619

[45] Jun. 9, 1981

[54] REUSABLE PICTURE FRAME

[75] Inventor: Erick Schmidt, Edmonton, Canada

[73] Assignee: General Systems Research Ltd., Edmonton, Canada

[21] Appl. No.: 108,246

[22] Filed: Dec. 27, 1979

Related U.S. Application Data

[63] Continuation of Ser. No. 848,473, Nov. 4, 1977, abandoned.

[51] Int. Cl.[3] ..... A47G 1/06; G09F 1/10

[52] U.S. Cl. ..... 40/154; 40/155; 40/156

[58] Field of Search ..... 40/152, 152.1, 154, 40/155, 156, 158 R, 158 B, 606, 609, 610, 611, 616, 209, 549; 52/475, 476, 656

[56] References Cited

U.S. PATENT DOCUMENTS

| | | | |
|---|---|---|---|
| 1,144,913 | 6/1915 | O'Quinn | 40/152 |
| 1,901,902 | 3/1933 | Draper | 40/154 |
| 2,581,843 | 1/1952 | Edwards | 40/156 |
| 2,654,451 | 10/1953 | Schmidgall | 40/152 |
| 3,613,280 | 10/1971 | Tuchinsky et al. | 40/155 |
| 3,654,719 | 4/1972 | Rochelt | 40/156 |
| 3,727,335 | 4/1973 | Rochelt | 40/156 |
| 3,956,839 | 5/1976 | Yoshida | 40/156 |
| 3,965,601 | 6/1976 | Neilsen | 40/155 |
| 4,030,220 | 6/1977 | Kotchen | 40/156 |
| 4,033,060 | 7/1977 | Lawrence | 40/154 X |
| 4,136,470 | 1/1979 | Barz | 40/152 |

FOREIGN PATENT DOCUMENTS

| | | | |
|---|---|---|---|
| 2328704 | 1/1974 | Fed. Rep. of Germany | 40/156 |
| 434986 | 9/1935 | United Kingdom | 40/152 |

*Primary Examiner*—John F. Pitrelli
*Assistant Examiner*—G. Lee Skillington
*Attorney, Agent, or Firm*—Millen & White

[57] ABSTRACT

A front-loading reusable picture frame is constructed of two nesting components. A rigid rectangular outer framework has first and second walls which define a forwardly facing seating and confining structure. A rectangular inner framework is formed by discrete side members having a continuously inwardly open channel for receiving a stack of framed elements whereby the side members may circumscribe the stack to bind its components. The inner framework seats within the outer framework and is confined therein.

10 Claims, 12 Drawing Figures

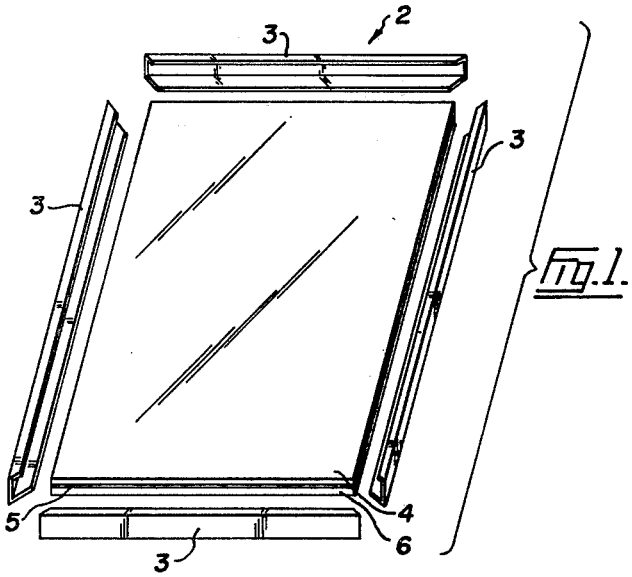
Fig. 1.
Fig. 2.
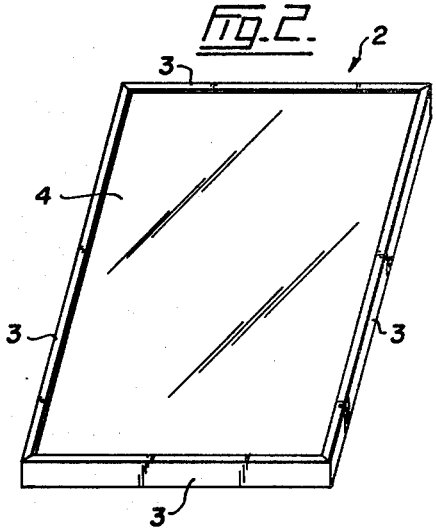
Fig. 3.
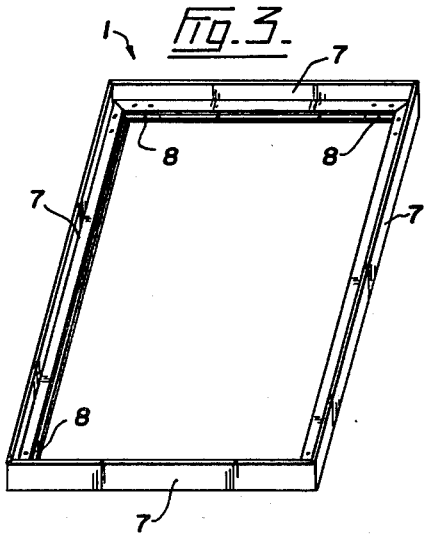
Fig. 4.
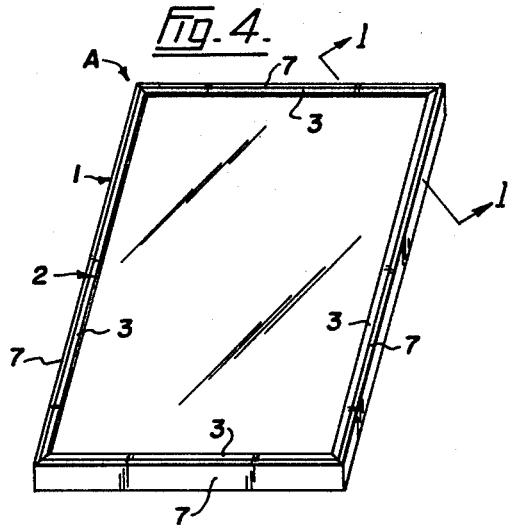
Fig. 5.
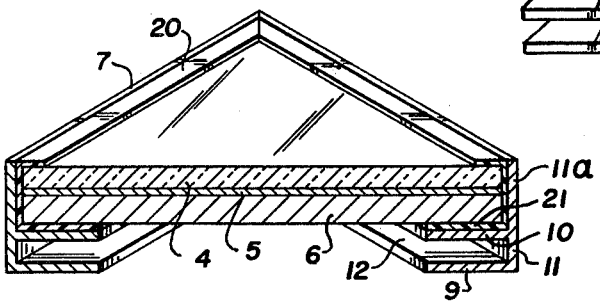
Fig. 6.
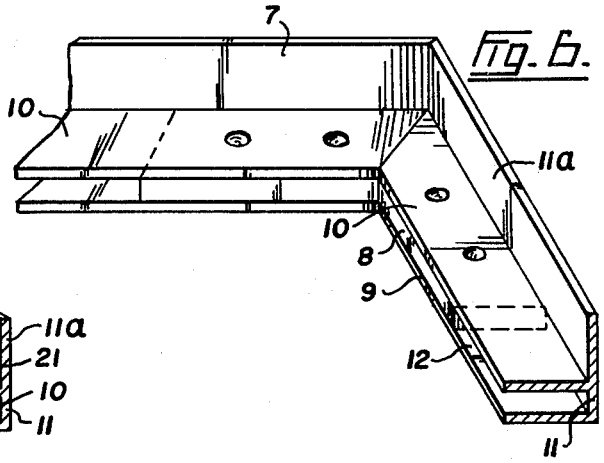

REUSABLE PICTURE FRAME

This is a continuation of application Ser. No. 848,473 filed Nov. 4, 1977, now abandoned.

BACKGROUND OF THE INVENTION

This invention relates to picture frames which may be disassembled to permit changing of the print, canvas, photograph or other image contained therein.

It is common practice to provide reusable rectangular picture frames comprising four extruded side members cut to a miter at each end. Each side member is commonly made of metal, to give it the necessary rigidity. It is also formed to provide two channels. One channel is designed to receive the stack of elements to be framed—commonly a backing plate, the image-bearing sheet, and a glass plate. The other channel receives right-angle locking elements, each of which form one pair of ends of a pair of side members into a right angle corner configuration and locks them in that condition. Thus the side members are assembled to form a rigid rectangular frame. The right angle elements typically comprise a pair of L-shaped plates. Screws extend through openings in one such plate and bear against the other plate; thus the plates may be forced apart so that they press against the walls of the channel in which they are disposed and give a friction lock.

A reusable frame therefore involves the following concepts:

1. Rigidity of the frame is required to give strength to the structure;

2. To permit reuse, the frame needs to be formed in sections which are mechanically but releasably locked together to form a unit—the locking devices used also force the sections into a right angle corner configuration; and 3. The sections are formed to provide a bounding channel, to hold the stack of framed elements, and a locking element channel, in which the mechanical locking devices are positioned.

There are certain disadvantages accruing to the reusable picture frames as previously described.

For example, the appearance of the unit cannot easily and cheaply be modified. More particularly, it is frequently desirable to be able to change the thickness of the frame molding or its coloration. Since the front wall of the extruded side member provides the molding in a conventional frame, the only way in which a supplier or user of frames can provide variation in this regard is to maintain a stock of relatively expensive side members having front walls of different thickness or coloration. It is one object of this invention to provide a frame in which the molding thickness or coloration can easily and cheaply be varied.

Another disadvantage of the conventional system is its relatively high cost. The need to make the extruded metal side member so it provides two channels and the use of screws and locking plates contribute to this cost. It is therefore another object of the invention to provide a simpler side member and to eliminate screws and tensioned metal spring clips to thereby reduce the cost of the frame.

SUMMARY OF THE INVENTION

In accordance with the present invention, a front-loading picture frame comprising two separate frameworks is provided. The outer framework consists of side members, preferably extruded, mitered, metal members, which are connected at their ends to form a rectangular rigid unit. Preferably the side members of the outer framework form a single first channel which opens inwardly in the main plane of the frame. Right angle locking elements are disposed in this channel at each corner; these elements may be riveted in place, to thereby form a permanent unit. The outer framework also preferably comprises a pair of walls disposed at a right angle, which form a forwardly facing seating and confining structure for the inner framework. In the preferred embodiment, the upper wall of the first channel also serves as the base wall of the seating and confining structure.

The rectangular inner framework comprises discrete side members which circumscribe and hold together the stack of elements to be framed. These inner framework side members have lower and upper inwardly projecting walls spaced apart by an upstanding wall, the walls forming a single second channel in which the margin of the stack is received. Preferably the inner framework side members are formed by extrusion and have mitered ends. The inner framework is sized to fit snugly in the seating and confining structure. If desired, releasable safety locking devices to interconnect the two frameworks may be provided.

The inner framework side members may be made of plastic, metal or wood composite. They can readily be changed at relatively low cost. Thus flexibility as to the molding design, color and thickness is available. A variety of inexpensive inner framework side members of differing thickness or color may be used with a single, relatively expensive outer framework.

Since the outer framework no longer needs to be disassembled, one may rivet the corner locking elements in place using a jig, thereby reducing manufacturing cost and obtaining more uniform and neat corner construction.

Broadly stated, the invention is a front-loading reusable picture frame for retaining a stack of framed elements comprising: rigid rectangular outer framework means having means defining a forwardly-facing seating and confining structure; and a rectangular inner framework comprising discrete side members, said side members having lower and upper inwardly projecting walls spaced apart by an upstanding wall, said walls forming a continuous inwardly open channel for receiving the stack of framed elements, whereby the side members may circumscribe the stack and hold its components together; said inner framework being receivable in the seating and confining structure whereby the outer framework means is operative to hold the inner framework together by frictional contact therebetween.

DESCRIPTION OF THE DRAWINGS

FIG. 1 is a perspective, exploded view showing a stack of the elements to be framed and the inner framework side members disposed therearound;

FIG. 2 is a perspective view of the parts of FIG. 1 in an assembled condition;

FIG. 3 is a perspective view of the outer framework;

FIG. 4 is a perspective view of the inner framework seated in the outer framework;

FIG. 5 is a perspective sectional view of a corner of the frame of the present invention, taken along the line 1—1 in FIG. 4;

FIG. 6 is a perspective view of a corner of the outer framework showing the right angle locking element in place;

DESCRIPTION OF THE PREFERRED EMBODIMENT

Figure 7:
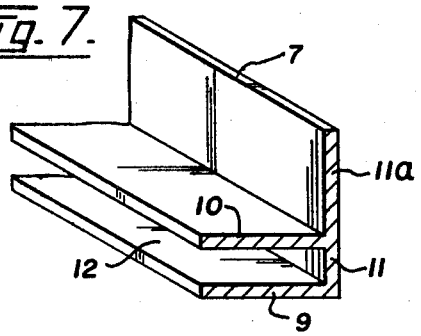
FIG. 7 is a cross-sectional view in perspective of the extruded side member used in the outer framework.

The picture frame A of the present invention is formed by two separate frameworks 1 and 2 which snugly fit together as shown in FIG. 4. The picture frame is front-loading in that the inner framework 2 is loaded from the front of the outer framework 1, where front infers that portion of the framework facing a viewer when he looks at a framed picture. The outer framework 1 provides the structural stability of the frame; it is manufactured of a rigid material, such as extruded aluminum, and formed into a unit which cannot be disassembled. The inner framework 2 is comprised of discrete side members 3 and may be disassembled. The side members 3 bind together the glass viewing plate 4, the image member 5 and the backing member 6. The inner framework 2 does not require structural strength, since it is seated and confined within the outer framework 1. Therefore plastic, for example, may be used to form the side members of the inner framework 1.

The rectangular outer framework 1 is illustrated in FIG. 3 and comprises four discrete, extruded, mitered metal side members 7 fastened together by locking elements 8. Each side member 7 comprises spaced lower and upper inwardly projecting walls 9, 10 which combine with an upstanding wall 11 to form a first channel 12 extending longitudinally along the base of the member. The inwardly projecting upper wall 10 and the upper portion 11*a* of the upstanding wall 11 combine to form a forwardly facing right angled seating and confining structure, that is a right angled seating and confining structure is formed which would face a viewer looking at the front of the frame.

Figure 8:
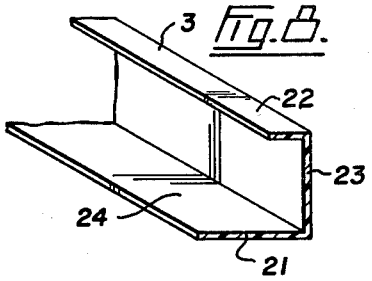
FIG. 8 is a cross-sectional view in perspective of the extruded member used in the inner framework.
Figure 9:
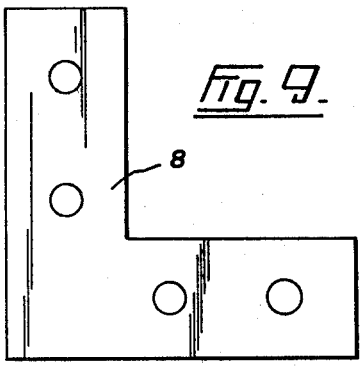
FIG. 9 is a top view of the right angled locking element used in the outer framework.
Figure 10:
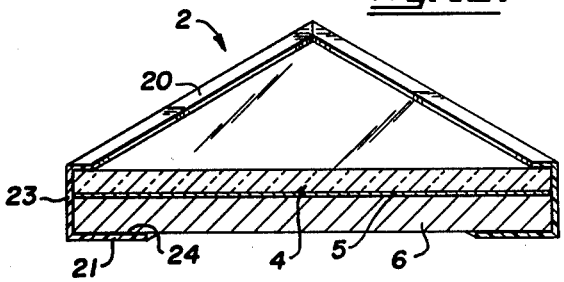
FIG. 10 is a perspective view of a corner of the inner framework and the contained stack.
Figure 11:
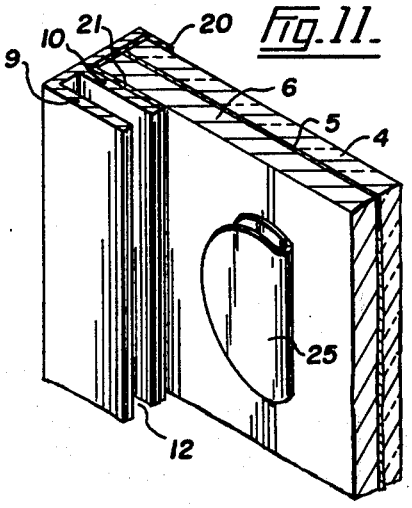
FIG. 11 is a partial view of the underside of an assembled frame showing the backing member bordered by the inner and outer framework members as well as an option U-shaped locking member ready to be locked into position.
Figure 12:
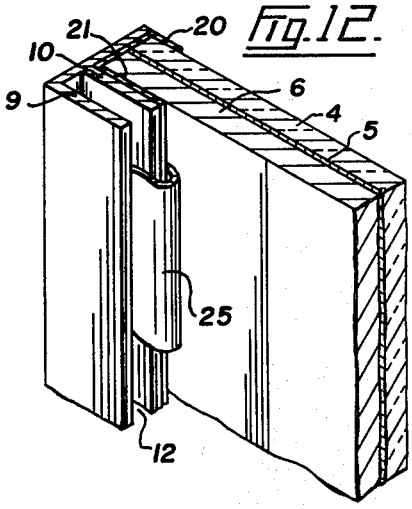
FIG. 12 is a partial view of the underside of an assembled frame showing the optional safety U-shaped locking member positioned to bind the inner and outer frameworks together.

The rectangular inner framework 2 is illustrated in FIGS. 2, 8 and 10. It comprises discrete, extruded, mitered, side members 20. Each side member 20 has lower and upper inwardly projecting walls 21, 22 spaced apart by an upstanding wall 23. The three walls 21, 22, 23 combine to form a second channel 24 which opens inwardly in the main plane of the frame. The width of the upstanding wall 23 may correspond with the width of the upper portion 11*a* of the outer framework wall, so that the upper inwardly projecting wall 22 (that is, the visible molding) is flush with the upper edge of the outer framework. The lower inwardly projecting wall 21 of the inner framework seats on the upper inwardly projecting wall 10 of the outer framework. It will be noted that the second channel 24 snugly receives the margin of the stack of elements (4, 5, 6) to be framed and functions to hold the elements together.

The extruded side members 20 are cut so that the outer dimensions of the inner framework are substantially equal to the inner dimensions of the seating and confining structure of the outer framework. Thus there is frictional engagement between the two frameworks so that one does not readily drop out of the other. If a further measure of locking is desired, safety U-shaped elements 25 may be provided to bind the lower wall 21 to the inner framework to the upper wall 10.

While the present invention has been disclosed in connection with a preferred embodiment thereof, it should be understood that there may be other embodiments which fall within the spirit and scope of the invention as defined by the following claims.

The embodiments of the invention in which an exclusive property or privilege is claimed are defined as follows:

1. A front-loading reusable picture frame for retaining a stack of elements to be framed comprising:

a rigid rectangular outer framework having means defining a forwardly facing seating and confining structure; and a rectangular inner framework comprising discrete side members, said side members having lower and upper inwardly projecting walls spaced apart from an upstanding wall, said walls forming a continuous inwardly open channel for receiving the stack of elements to be framed, whereby the side members may circumscribe the stack and hold the stack together;

said inner framework being frontally visible and snugly receivable in the seating and confining structure whereby the outer framework is operative to hold together and retain the inner framework by frictional contact therebetween, without the use of frontally visible locking means.

2. A front-loading reusable picture frame as set forth in claim 1, wherein the outer framework includes first and second walls defining the forwardly facing seating and confining structure, and wherein the inner framework comprises discrete mitered side members.

3. The picture frame as set forth in claim 2, wherein:

said outer framework is comprised of discrete extruded metal mitered side members held together at their ends by corner elements, each such corner element connecting a pair of side members meeting to form a corner.

4. A front-loading reusable picture frame as set forth in claim 3, wherein removable means are provided for additionally locking together the outer framework means and the inner framework.

5. A front-loading reusable picture frame for retaining a stack of elements to be framed comprising:

a rigid rectangular outer framework comprising discrete extruded mitered metal side members, each such side member forming an inwardly opening first channel, and a corner element disposed at each corner of the framework, said corner element extending into the first channels of the two side members forming the corner and being permanently fastened to said two side members to hold them in a right angle corner position;

said framework having first and second walls defining a forwardly facing seating and confining structure, said first wall being disposed generally parallel to the main plane of the frame, said second wall upstanding from the outer edge of the first wall;

a rectangular inner framework comprising discrete extruded mitered plastic side members, said side members having lower and upper inwardly projecting walls spaced apart by an upstanding wall, said walls forming a continuous inwardly open channel for receiving the stack of elements to be framed, whereby the side members may circumscribe the stack and hold the stack together;

said inner framework being frontally visible and snugly receivable in the seating and confining structure, whereby the outer framework is operative to hold together and retain the inner framework by frictional contact therebetween, without the use of frontally visible locking means.

6. The picture frame as set forth in claim 5, comprising:

removable means for locking together the inner and outer frameworks, said removable means comprising U-shaped elements inserted at the rear of the picture frame between the lower wall of the inner framework and the first channel of the outer framework.

7. A front-loading reusable picture frame for retaining a stack of elements to be framed, and comprising an outer framework including a peripheral confining side wall merging into a bottom seating wall extruding inwardly at substantially right angles thereto with both said walls defining a forwardly facing seating and confining structure; an inner framework complementing the peripheral configuration of the outer framework and including side members having lower and upper inwardly projecting walls spaced apart by an upstanding outer wall and defining a continuous inwardly open channel for receiving the stack of elements to be framed whereby the side members may circumscribe the stack and hold the stack together; and the outer peripheral dimensions of the upstanding wall of the inner framework being substantially equal to the inner dimensions of the peripheral confining side wall of the outer framework for frictional snug engagement between the walls as the inner framework is visibly and snugly received in the seating and confining structure of the outer framework with the lower inwardly projecting wall of the inner framework seating on the bottom seating wall of the outer framework and held therein without the use of frontally visible locking means.

8. A front-loading reusable picture frame as set forth in claim 7, wherein the outer framework is substantially rectangular and formed of mitered wall sections forming corners of the framework, and wherein generally right-angled corner elements secure together the mitered corners along the undersurface of the bottom seating wall by means leaving the upper surface thereof free for seating of the inner framework thereon.

9. A front-loading reusable picture frame as set forth in claim 8, wherein the outer framework includes an inner wall extending inwardly from the confining side wall and spaced from the bottom seating wall to provide therewith an inwardly open channel space covering the corner elements and providing space for receiving removable means for additionally locking together the inner and outer framework.

10. A front-loading reusable picture frame as set forth in claim 9, wherein there are provided removable means in the form of U-shaped elements with one leg housed within the inwardly open channel space to engage the expanded surface of the bottom seating wall of the outer framework and with the other leg engaging the inner surface of the lower side member of the inner framework to thus additionally lock together the two frameworks at the rear blind sides thereof.

* * * * *